US007637416B2

(12) United States Patent
Moelich et al.

(10) Patent No.: US 7,637,416 B2
(45) Date of Patent: Dec. 29, 2009

(54) AIR FLOW CHANNEL

(75) Inventors: Dawid Moelich, Bellville (ZA); Marius Leuvennink, Stellenbosch (ZA); Pieter Dippenaar, Strand (ZA)

(73) Assignee: Capespan (Pty) Ltd, Stellenbosch (ZA)

( * ) Notice: Subject to any disclaimer, the term of this patent is extended or adjusted under 35 U.S.C. 154(b) by 746 days.

(21) Appl. No.: 10/556,027

(22) PCT Filed: Sep. 28, 2004

(86) PCT No.: PCT/IB2004/051893

§ 371 (c)(1),
(2), (4) Date: Nov. 8, 2005

(87) PCT Pub. No.: WO2005/032974

PCT Pub. Date: Apr. 14, 2005

(65) Prior Publication Data

US 2007/0036884 A1 Feb. 15, 2007

(30) Foreign Application Priority Data

Oct. 1, 2003 (ZA) ..... 2003/7658

(51) Int. Cl.
*B65D 5/42* (2006.01)

(52) U.S. Cl. ..... 229/120; 220/913; 229/120.16; 229/120.17; 229/120.18

(58) Field of Classification Search ..... 229/120, 229/120.1, 916, 109, 120.16, 120.17, 120.18; 220/527, 557, 676, 913
See application file for complete search history.

(56) References Cited

U.S. PATENT DOCUMENTS 1,397,583 A * 11/1921 Huber ..... 229/120.1
1,706,804 A * 3/1929 Miller ..... 229/120.1
1,733,566 A * 10/1929 Weaver ..... 229/120.1
1,993,112 A 3/1935 Patterson
2,083,623 A * 6/1937 Thorup ..... 229/120.1
2,232,632 A * 2/1941 Reynolds ..... 229/120.1
2,319,974 A * 5/1943 Buttery ..... 229/109
2,322,239 A * 6/1943 Kramer ..... 229/120.1
2,415,143 A * 2/1947 Miller ..... 229/120.1
2,743,050 A * 4/1956 Crane ..... 229/916
2,749,011 A 6/1956 Lebow
2,804,252 A 8/1957 Nute
2,841,319 A * 7/1958 White et al. ..... 229/120
2,858,059 A * 10/1958 Kitchell ..... 229/916
2,925,213 A * 2/1960 Zukoski ..... 229/109
3,101,881 A * 8/1963 Crane ..... 229/120

(Continued)

FOREIGN PATENT DOCUMENTS

EP 1 291 284 3/2003

(Continued)

*Primary Examiner*—Gary E Elkins
(74) *Attorney, Agent, or Firm*—Stites & Harbison PLLC; B. Aaron Schulman; Stephen J. Weyer

(57) ABSTRACT

There is disclosed an air flow channel (32, 38) for use in a packaging container (10). The channel includes an elongated body defining a passage having an open end. A number of spaced apart ventilation openings (36) are provided through the body along its length. The channel can be fixed attached to or alternatively integrally formed with a wall (14, 16, 18, 20), floor (12) or roof of the container.

10 Claims, 6 Drawing Sheets

U.S. PATENT DOCUMENTS

| | | | | | |
|---|---|---|---|---|---|
| 3,145,902 | A * | 8/1964 | Nolen | 229/120.17 |
| 3,695,505 | A * | 10/1972 | Wolf | 229/120.17 |
| 3,907,108 | A * | 9/1975 | Weimer, Jr. | 229/120.18 |
| 5,666,763 | A | 9/1997 | Kao | |
| 6,390,357 | B1 * | 5/2002 | Ogryzlo et al. | 229/120 |

FOREIGN PATENT DOCUMENTS

| | | |
|---|---|---|
| GB | 1 327 641 | 8/1973 |
| GB | 2 010 462 | 6/1979 |
| JP | 2001-199438 | 7/2001 |
| SU | 1027096 | 7/1983 |
| SU | 1271795 | 11/1986 |
| SU | 1805084 | 3/1993 |
| WO | WO-2005/003297 | 1/2005 |

* cited by examiner

AIR FLOW CHANNEL

FIELD OF INVENTION

The present invention relates to an air flow channel.

More particularly, the present invention relates to an air flow channel for a packaging container.

BACKGROUND TO INVENTION

Produce, such as agricultural produce or meat or fish, is normally packaged into a container for storage and transport to wholesale or retail outlets. Depending on the type of produce, the container is often made of a cardboard material, which is provided with an internal lining and/or produce tray. Occasionally agricultural produce is also packaged into individual bags inside the lining, e.g. bunches of grapes. Furthermore, an additional desiccant sheet is sometimes placed into the container to absorb any moisture or condensation that is present in the container.

A disadvantage of all the additional packaging that is inserted into the container is that the packaging tends to block any ventilation holes that are provided in the container. Thus air cannot flow into or out from the container to correctly refrigerate or aerate the produce and resulting in inconsistent and slow cooling of the produce from ambient temperatures to required storage temperatures. This leads to poorer quality produce being delivered to retail outlets.

When exporting produce to certain countries, the produce may be treated with gas fumigants, such as sulphur dioxide or methyl bromide. The gas should therefore be able to quickly and fully penetrate the container, and if necessary, be able to be effectively extracted upon termination of the treatment.

It is an object of the present invention, to suggest an air flow channel for a packaging container, which will assist in overcoming these problems.

SUMMARY OF INVENTION

According to the invention, an air flow channel for use in a packaging container includes at least one elongated body defining at least one passage having at least one open end; and a number of spaced apart ventilation openings provided through the body along its length.

The passage(s) may have opposite open ends.

The body may be substantially triangular when seen in end view.

The body may be a tubular member.

The body may include at least one attachment stub adapted to allow secure attachment to a packaging container.

The body may be adapted to be attached to a packaging container along its base, one or more of its side walls or its lid.

The air flow channel may be adapted to be glued to the packaging container.

The ventilation openings may be slots.

The air flow channel may be made of polystyrene foam.

Also according to the invention, a packaging container includes a base; a circumferential wall extending from the base and defining a chamber adapted to receive produce; a number of ventilation openings provided in the circumferential wall and/or base leading into the chamber; and at least one air flow channel formed along the circumferential wall and/or base and extending at least partially between at least two ventilation openings.

The packaging container may be made of cardboard, corrugated board or plastics material.

The packaging container may be substantially rectangular in shape, the circumferential wall having two substantially parallel side walls and two substantially parallel ends walls extending substantially perpendicularly to the base.

The packaging container may have bevelled walls between each of the side walls and end walls for forming an octagonal container.

A ventilation opening may be provided in any one or each of the side walls.

A ventilation opening may be provided in any one or each of the end walls.

A ventilation opening may be provided in any one or each of the bevelled walls.

The ventilation openings may be positioned so that when two similar packaging containers are placed beside each other, the ventilation openings are adapted to be in line with each other so that air may flow from one packaging container to the other.

The air flow channel or at least one of the air flow channels may be substantially linearly provided between two ventilation openings.

The air flow channel or at least one of the air flow channels may be formed between the ventilation openings by a row of adjacent tabs.

The tabs may be formed by cutting through the base along a stepped line.

The tabs may be bent into the chamber.

The tabs may be shaped in a truncated wedge form so that their free ends are wider than their ends joined to the base.

In an erected state, the free ends of the tabs may be jammed against each other so that they are held in place by a friction fit.

The air flow channel or at least one of the air flow channels may be formed by folding a linear section of the base and circumferential wall into the chamber, thereby compressing the container.

The packaging container may include crease lines along which the linear section can be folded.

The packaging container may include a separate fixation wall being adapted to be fixedly attached to the circumferential wall to prevent re-expansion of the container.

The produce may be agricultural produce, such as fruit or vegetables or herbs or flowers, or any other edible product, such as meat or fish.

The invention extends to a packaging container provided with an air flow channel as set out herein.

BRIEF DESCRIPTION OF DRAWINGS

The invention will now be described by way of example with reference to the accompanying schematic drawings.

In the drawings there is shown in.

DETAILED DESCRIPTION OF DRAWINGS

Figure 1:
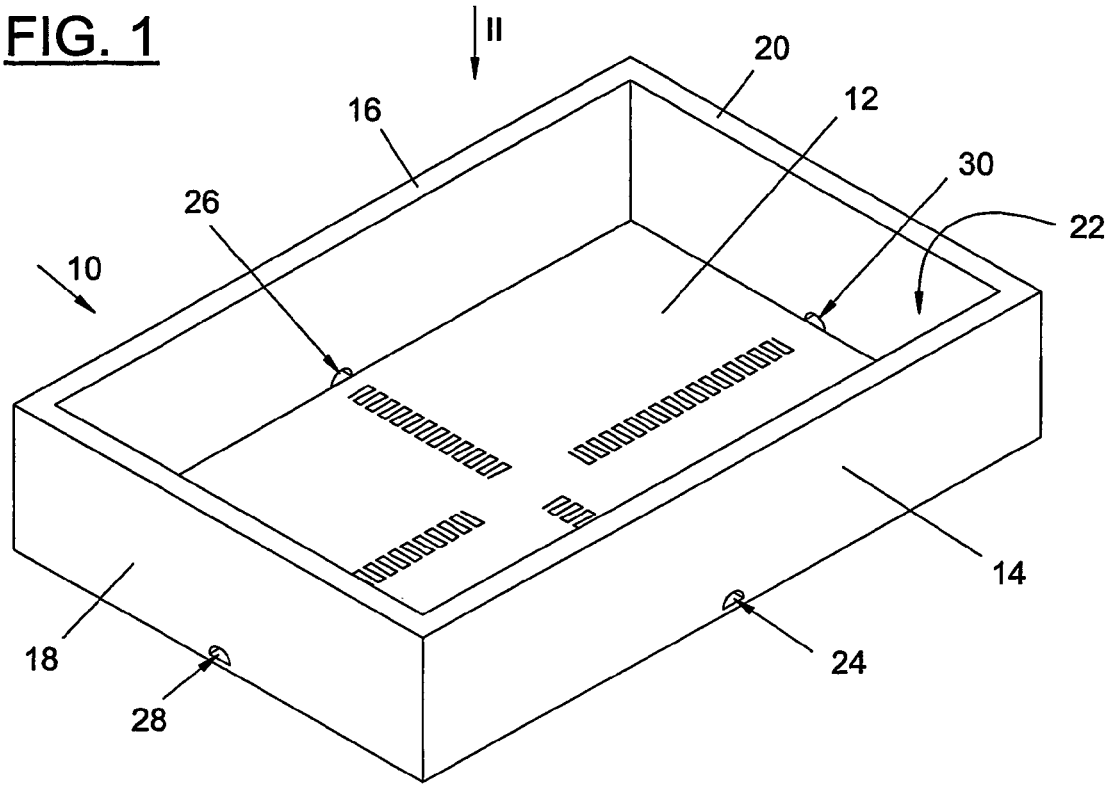
FIG. 1 A perspective view of a packaging container provided with an air flow channel in accordance with the invention, with its tabs shown in a flat configuration.
Figure 2:
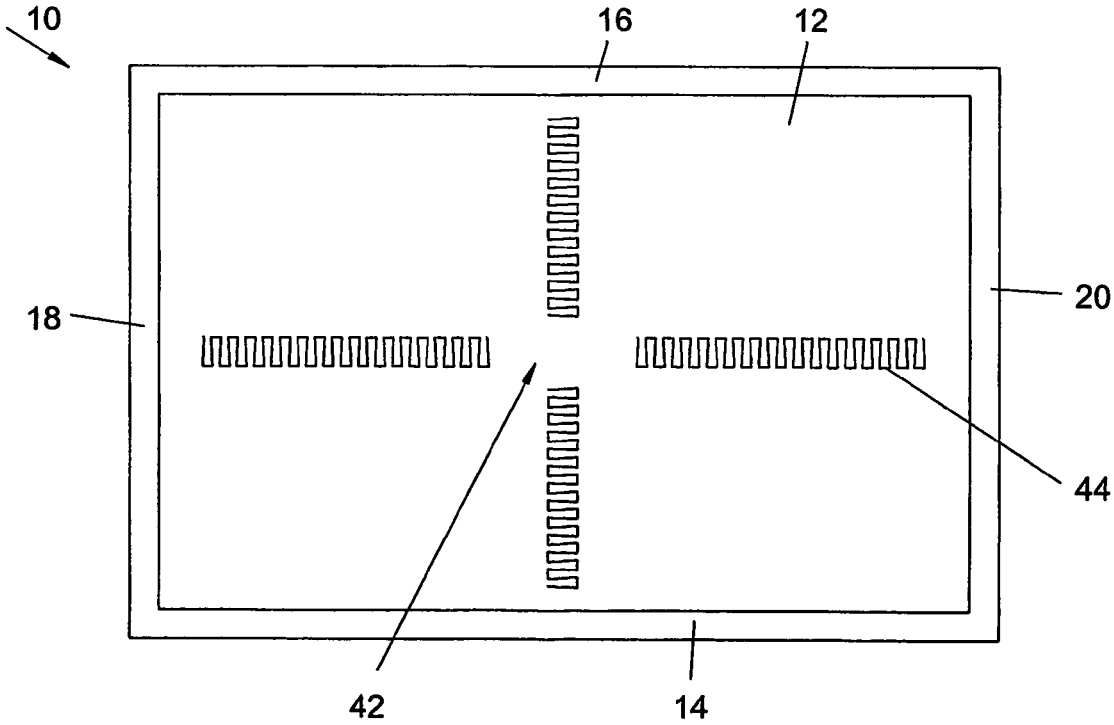
FIG. 2 A plan view seen along arrow II in FIG. 1.
Figure 3:
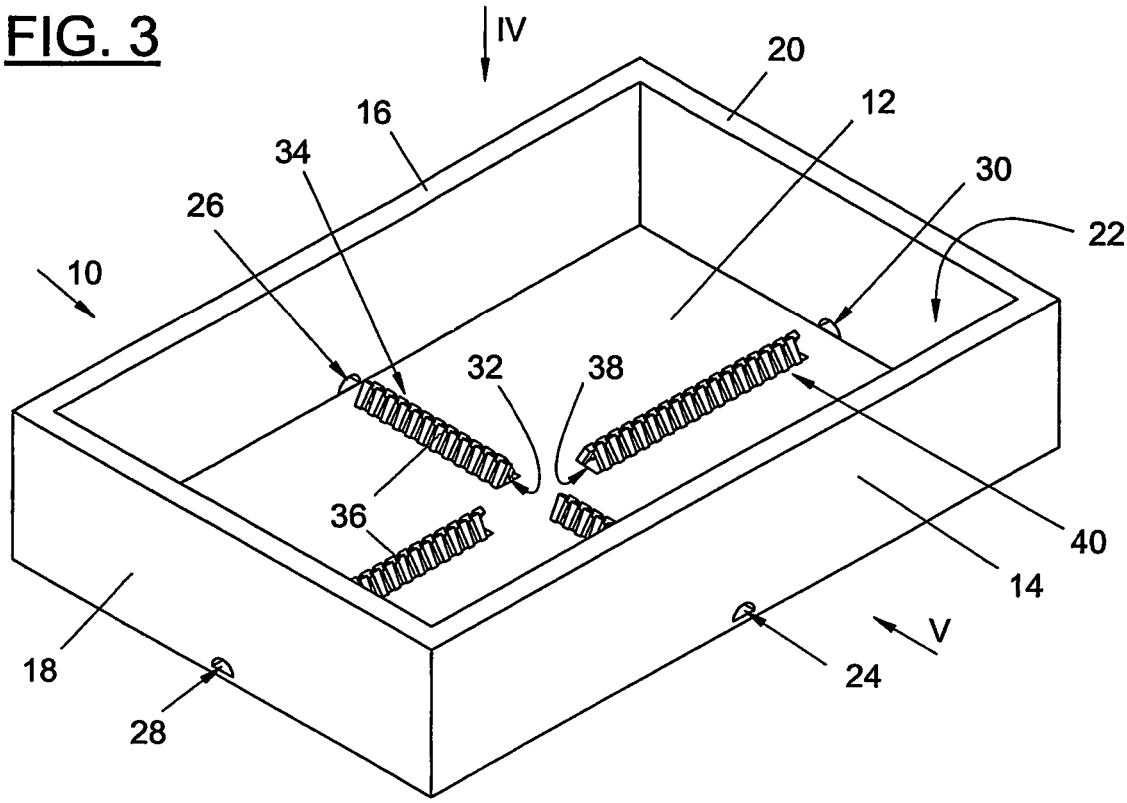
FIG. 3 A perspective view of the packaging container of FIGS. 1 and 2, showing the tabs shown in a raised configuration.
Figure 4:
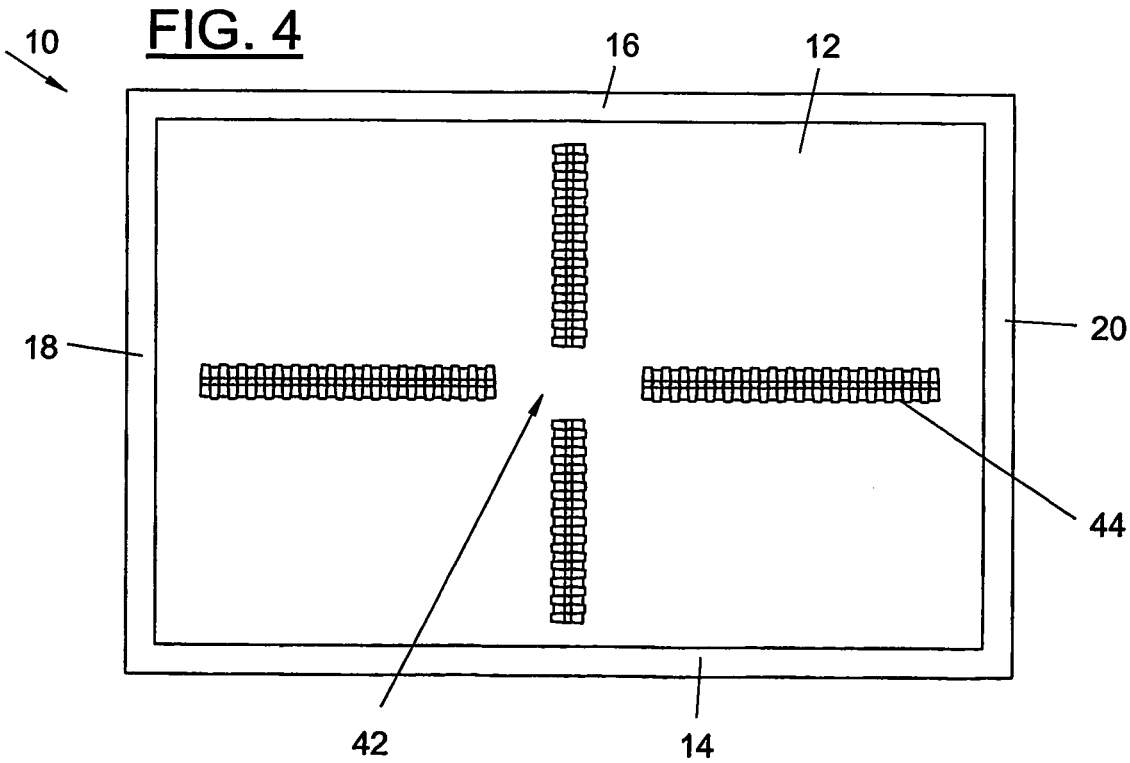
FIG. 4 A plan view seen along arrow IV in FIG. 3.
Figure 5:
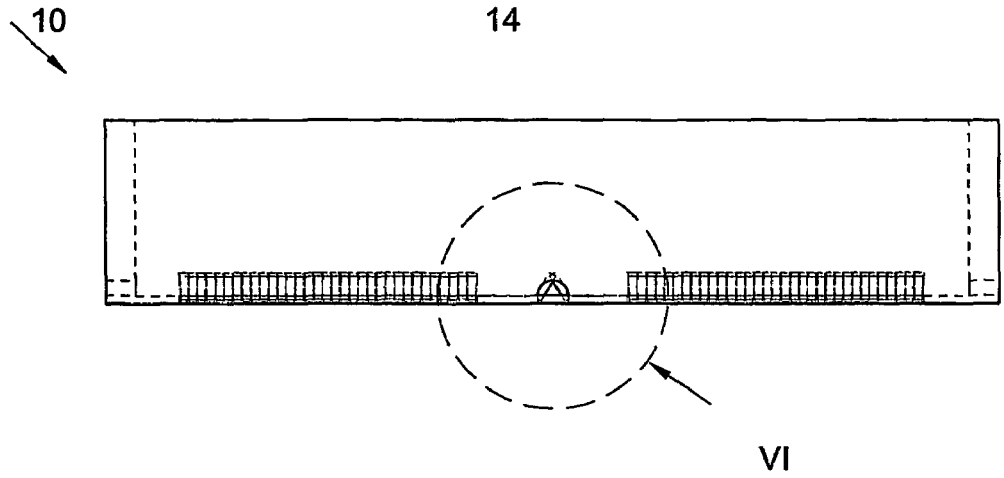
FIG. 5 A side view seen along arrow V in FIG. 3.
Figure 6:
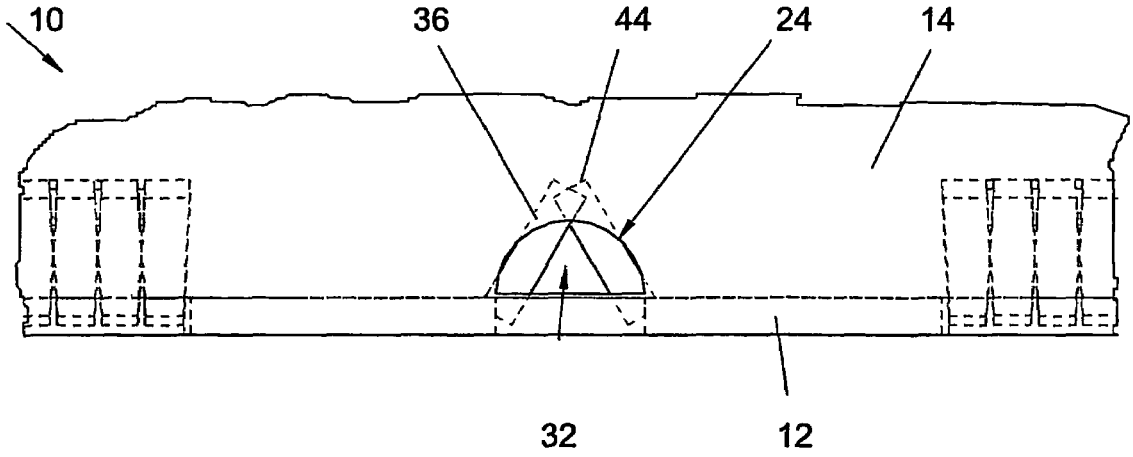
FIG. 6 On an enlarged scale, a side view of the part indicated by arrow VI in FIG. 5.

Referring to the drawings, a packaging container for containing produce in accordance with the invention, generally indicated by reference numeral 10, is shown. The packaging container 10 includes a base 12, from which extends a pair of substantially parallel side walls 14,16 and a pair of substantially parallel end walls 18,20 so as to define an open chamber 22.

Ventilation openings 24,26,28,30 are respectively provided in each of the side walls 14,16 and each of the end walls 18,20, with the ventilation openings 24,26,28,30 being located relatively near to the base 12. The ventilation openings 24,26,28,30 are positioned in the side walls 14,16 and end walls 18,20 so that when two or more packaging containers 10 are placed beside each other, then their respective ventilation openings 24,26,28,30 may be adjacent to each other so that air can flow from one packaging container 10 to the other.

Within the packaging container 10, an air flow channel 32 is formed between the ventilation openings 24 and 26 by a row 34 of adjacent tabs 36, which are cut into the base 12 and bent into the chamber 22. A similar second air flow channel 38 is formed between the ventilation openings 28 and 30 by a further row 40 of adjacent tabs 36, which are cut into the base 12 and bent into the chamber 22.

A blank space 42, in which there are no tabs 36, is left in the vicinity of the intersection of the rows 34 and 40 so that the base 12 is not overly weakened and thus preventing effective use of the packaging container 10. A container insert, similar to the insert 50 as described hereinafter, may be provided to form an air flow channel over the blank space 42 to prevent blocking of the air flow channels 32,38.

The tabs 36 are formed by cutting through the base 12 along a stepped line. The tabs 36 are shaped in a truncated wedge form so that their free ends 44 are wider than their ends joined to the base 12. Thus when the tabs 36 are bent into the chamber 22, their free ends 44 are jammed against each other and held in place by a friction fit. This reduces the likelihood of the tabs 36 collapsing under gravity or from being pressed flat when goods are placed into the chamber 22.

In use, when a lining (not shown) is inserted into the chamber 22, the lining conforms itself to the base 12 and lies over the rows 34,40. This allows air to flow in through the ventilation openings 24,26,28,30 and along the air flow channels 32,38. The air can exit the air flow channels 32,38 in the spaces formed between the tabs 36 and is properly distributed throughout the chamber 22.

Example 1

Figure 9:
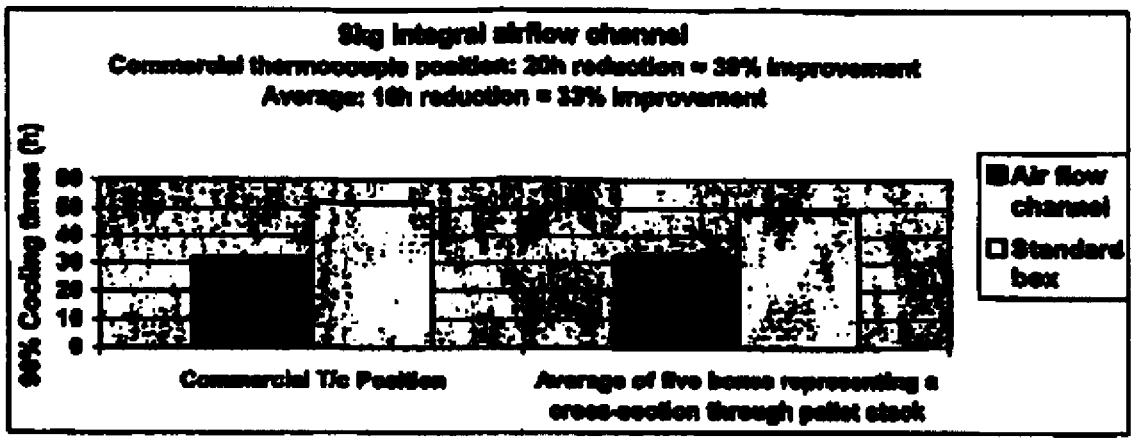
FIG. 9 Graph showing cooling effect provided by an air flow channel in a 9 kg packaging container.

FIG. 9 shows an analysis of the cooling effect provided by the air flow channels 32,38 in a packaging container 10 in comparison to a standard packaging container not having any air flow channels. The analysis was conducted on produce provided in a 9 kg capacity packaging container 10 and the time was measured for the produce to be cooled from ambient temperature to 90% of the requisite storage temperature.

During normal commercial testing, a single thermocouple is placed in a container located in the centre of a commercial pallet stack to determine the cooling effect experienced by that container. This is then deemed to be the cooling for the entire pallet stack. The current analysis comparison was conducted once with a thermocouple placed in such a commercial testing position. Thereafter the analysis was repeated with five thermocouples randomly spaced amongst the containers in the pallet to represent a cross-section through the pallet. An average of the cooling times for the five thermocouples was calculated to provide a more accurate record of the cooling effect experienced by the containers in the entire pallet.

As can be seen from FIG. 1, the commercial testing thermocouple testing position showed a 39% improvement in the cooling time for the container 10 in comparison to the time required for cooling the standard container. The multiple thermocouple test showed a 33% improvement in the time required to achieve the requisite cooling in the container 10 in comparison to the time required for cooling the standard container.

Figure 7:
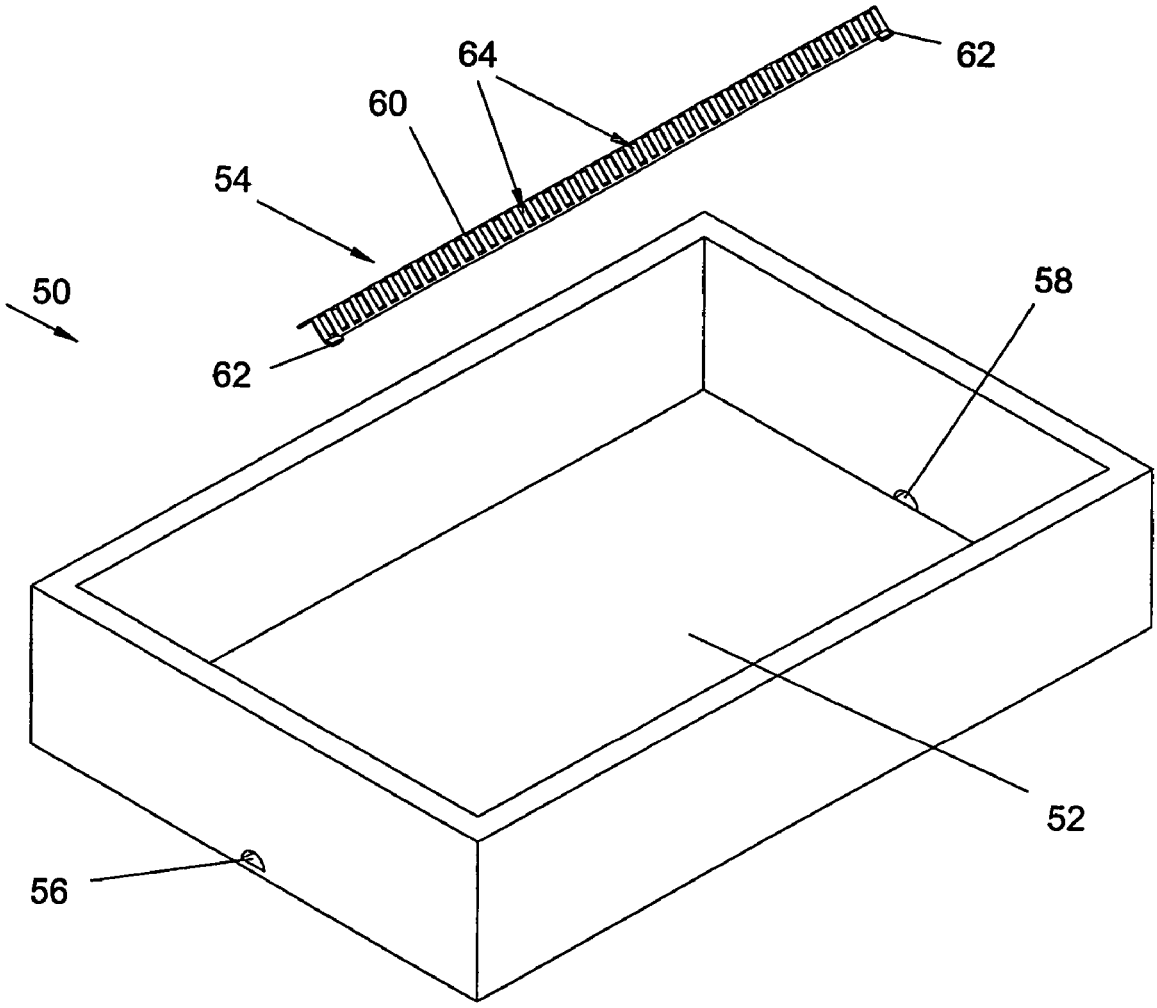
FIG. 7 An exploded perspective view of a second embodiment of a packaging, container provided with an air flow channel in accordance with the invention.

Referring now to FIG. 7, a second embodiment of a packaging container provided with an air flow channel in accordance with the invention, generally indicated by reference numeral 50, is shown. The packaging container 50 does not include a row of tabs along its base 52, but in place thereof a container insert 54 is inserted into the container 50 between its ventilation openings 56,58. The insert 54 includes an elongated body 60 having a stub 62 at either end for being fixedly attached to the base 52. A number of spaced apart openings 64, such as slots, extend through the body 60.

As the base 52 is not cut to form the tabs 36, it will not be weakened, but the insert 52 may increase manufacturing costs as additional material and assembly steps will have to be used in the formation of the container 50. The insert 54 can also provide additional strength to the base 52, allowing the container 50 to be made from a lighter grade material for recouping some of the additional expense.

Example 2

Figure 10:
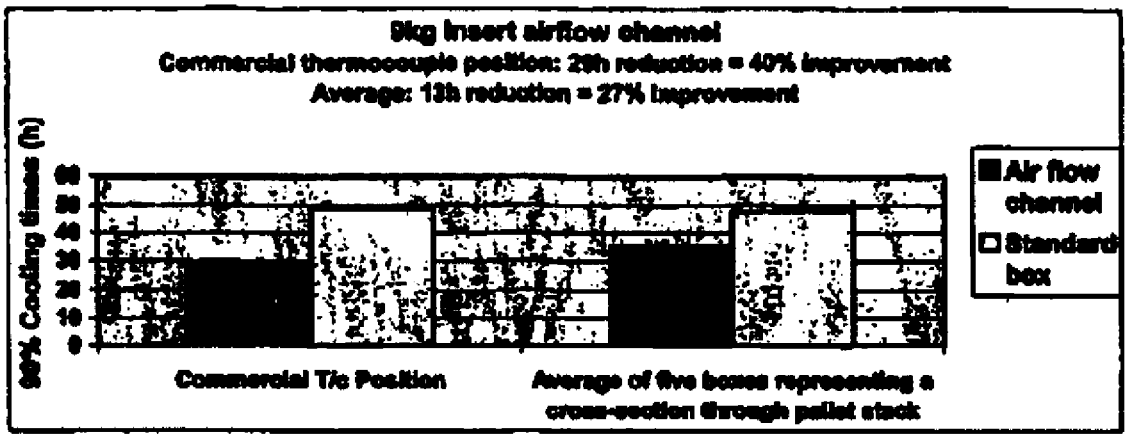
FIG. 10 Graph showing cooling effect provided by a container insert in a 9 kg packaging container.

FIG. 10 shows an analysis of the cooling effect provided by the container insert 54 in a packaging container 50 in comparison to a standard packaging container not having an insert. The analysis was, conducted on produce provided in a 9 kg capacity packaging container 50 and the time was measured for the produce to be cooled from ambient temperature to 90% of the requisite storage temperature.

As in Example 1, the current analysis comparison was conducted once with a thermocouple placed in a commercial testing position. Thereafter the analysis was repeated with five thermocouples randomly spaced amongst the containers in the pallet to represent a cross-section through the pallet. An average of the cooling times for the five thermocouples was calculated to provide a more accurate record of the cooling effect experienced by the containers in the entire pallet.

As can be seen from FIG. 10, the commercial testing thermocouple testing position showed a 40% improvement in the cooling time for the container 50 in comparison to the time required for cooling the standard container. The multiple thermocouple test showed a 27% improvement in the time required to achieve the requisite cooling in the container 50 in comparison to the time required for cooling the standard container.

Figure 8:
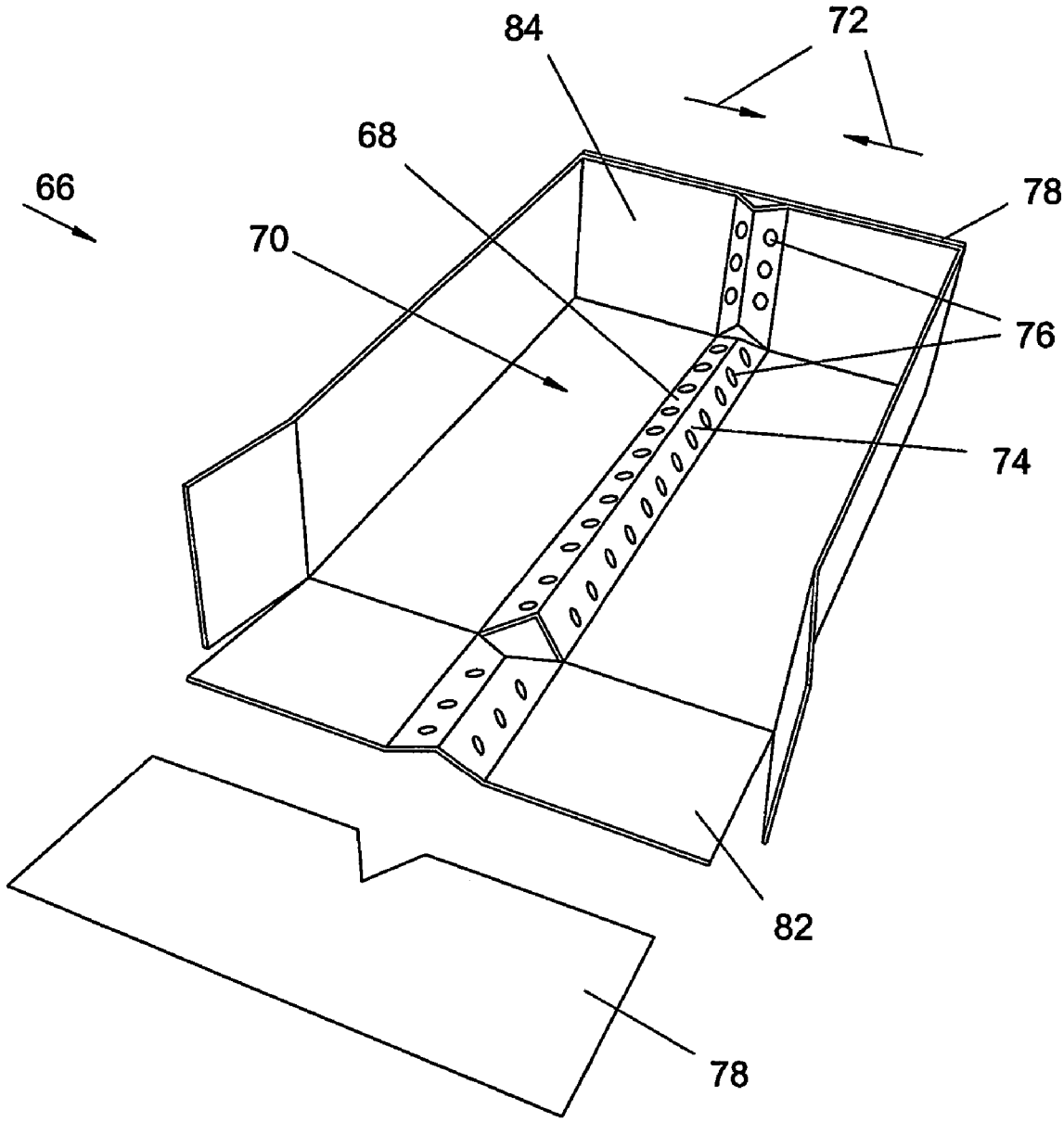
FIG. 8 A perspective view of a third embodiment of a packaging container provided with an air flow channel in accordance with the invention.

Referring now to FIG. 8, a third embodiment of a packaging container provided with an air flow channel according to the invention, generally indicated by reference numeral 66, is shown. The packaging container 66 includes a linear centre section 68 formed by providing crease lines in the container 66. The centre section 68 is folded into the chamber 70 by slightly compressing the container 66 along its width (as indicated by arrows 72) to form an air flow channel 74, which is provided with openings 76. Separate fixation walls 78,80 are then respectively glued to the end walls 82,84 of the container 66 to maintain the compressed form of the container 66 and thereby to maintain the shape of the air flow channel 74.

The packaging containers 10,50,66 can be of any shape in plan view, for example such as rectangular, octagonal, triangular or any other shape required for packaging or marketing purposes.

The packaging containers 10,50,66 can be made from cardboard, corrugated board or plastics material.

The produce can be agricultural produce, such as fruit or vegetables or herbs or flowers, or it can be fish or meat or any other produce requiring packaging and transport in a ventilated/refrigerated packaging container.

The invention claimed is:

1. A packaging container including a base; a circumferential wall extending from the base and defining a chamber adapted to receive produce; a number of ventilation openings provided in the circumferential wall leading into the chamber; an air flow channel adapted to be formed along the base and extending at least partially between at least two of the ventilation openings; and a row of adjacent tabs provided in the base being adapted to be folded into the chamber to form the air flow channel, the tabs having fixed ends joined to the base and opposite free ends, the tabs being foldable at the fixed ends to form the air flow channel.

2. A packaging container as claimed in claim 1, which is made of cardboard, corrugated board or plastics material.

3. A packaging container as claimed in claim 1, which is substantially rectangular in shape, the circumferential wall having two substantially parallel side walls and two substantially parallel ends walls extending substantially perpendicularly to the base.

4. A packaging container as claimed in claim 3, in which the ventilation openings are provided in the side walls.

5. A packaging container as claimed in claim 3, in which the ventilation openings are provided in the end walls.

6. A packaging container as claimed in claim 1, in which the air flow channel is substantially linearly provided between two of the ventilation openings.

7. A packaging container as claimed in claim 1, in which the tabs are formed by cuffing through the base along a stepped line.

8. A packaging container as claimed in claim 1, in which the tabs are folded into the chamber.

9. A packaging container as claimed in claim 1, in which the tabs are shaped in a truncated wedge form, wherein the free ends are wider than the fixed ends.

10. A packaging container as claimed in claim 9, in which, in an erected state, the free ends of the tabs engage with each other to be held in place by a friction fit.

* * * * *

UNITED STATES PATENT AND TRADEMARK OFFICE

CERTIFICATE OF CORRECTION

PATENT NO. : 7,637,416 B2
APPLICATION NO. : 10/556027
DATED : December 29, 2009
INVENTOR(S) : Moelich et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1086 days.

Signed and Sealed this

Ninth Day of November, 2010

David J. Kappos

David J. Kappos
*Director of the United States Patent and Trademark Office*